US009355772B2

(12) United States Patent
Navarro

(10) Patent No.: US 9,355,772 B2
(45) Date of Patent: May 31, 2016

(54) TRANSFORMER PROVIDED WITH A TAPS PANEL, AN ELECTRIC-INSULATION METHOD FOR A TAPS PANEL OF A DRY DISTRIBUTION TRANSFORMER, AND A TAPS PANEL FOR A DRY DISTRIBUTION TRANSFORMER

(75) Inventor: Martin Alsina Navarro, Jundiai (BR)

(73) Assignee: SIEMENS LTDA., Sao Paulo (BR)

( * ) Notice: Subject to any disclaimer, the term of this patent is extended or adjusted under 35 U.S.C. 154(b) by 93 days.

(21) Appl. No.: 13/885,095

(22) PCT Filed: Apr. 16, 2012

(86) PCT No.: PCT/BR2012/000106

§ 371 (c)(1),
(2), (4) Date: Jan. 6, 2014

(87) PCT Pub. No.: WO2012/139187

PCT Pub. Date: Oct. 18, 2012

(65) Prior Publication Data

US 2014/0118101 A1 May 1, 2014

(30) Foreign Application Priority Data

Apr. 15, 2011 (BR) ..... 1101495

(51) Int. Cl.
*H01F 27/02* (2006.01)
*H01F 29/02* (2006.01)
(Continued)

(52) U.S. Cl.
CPC ..... *H01F 29/025* (2013.01); *H01F 27/02* (2013.01); *H01F 27/06* (2013.01); *H01F 27/08* (2013.01);
(Continued)

(58) Field of Classification Search
CPC ..... H01F 27/00–27/30
USPC ..... 336/55–62, 180–184, 220–223
See application file for complete search history.

(56) References Cited

U.S. PATENT DOCUMENTS 3,175,148 A 3/1965 Swoish et al.
3,504,319 A * 3/1970 Merrill ..... H01F 27/266 174/37

(Continued)

FOREIGN PATENT DOCUMENTS

BR PI0903695 A2 2/2011
CN 201311835 Y 9/2009

(Continued)

OTHER PUBLICATIONS

International Searching Authority, International Search Report and Written Opinion for International Application No. PCT/BR2012/000106, Aug. 22, 2012, 8 pages, European Patent Office, The Netherlands.

(Continued)

*Primary Examiner* — Tuyen Nguyen
(74) *Attorney, Agent, or Firm* — Laurence Greenberg; Werner Stemer; Ralph Locher

(57) ABSTRACT

The present invention relates to a dry distribution transformer comprising a housing (1'), a coil (200), a sealed compartment (100) and a taps panel (110) associated to the coil (200). The taps panel (110) has an electrostatic shield (107) and is positioned inside the sealed compartment (100), the sealed compartment (100) being filled with a solid dielectric material and protected by a cover (120). One also describes an electric insulation method for a taps panel of a dry distribution transformer and taps panel for a dry distribution transformer filled with removable insulating resin. The coil (200) has a grounded (115) electrostatic shield (107).

13 Claims, 6 Drawing Sheets

(51) Int. Cl.

| | |
|---|---|
| ***H01F 27/06*** | (2006.01) |
| ***H01F 27/08*** | (2006.01) |
| ***H01F 27/36*** | (2006.01) |
| ***H01F 41/00*** | (2006.01) |
| *H01F 27/32* | (2006.01) |

(52) U.S. Cl.
CPC ..... *H01F 27/362* (2013.01); *H01F 41/005* (2013.01); *H01F 2027/328* (2013.01); *Y10T 29/4902* (2015.01)

(56) References Cited

U.S. PATENT DOCUMENTS

| | | | | |
|---|---|---|---|---|
| 4,504,811 | A * | 3/1985 | Stunzi ..... | H01H 15/08 200/11 TC |
| 5,621,372 | A | 4/1997 | Purohit | |
| 8,228,155 | B2 | 7/2012 | Sarver et al. | |
| 8,614,614 | B2 | 12/2013 | Navarro et al. | |

FOREIGN PATENT DOCUMENTS

| | | | |
|---|---|---|---|
| CN | 101553966 | A | 10/2009 |
| CN | 202004355 | U | 10/2011 |
| JP | 57114214 | A | 7/1982 |
| JP | 10055922 | A | 2/1998 |
| WO | WO 2008/063296 | A1 | 5/2008 |

OTHER PUBLICATIONS

State Intellectual Property Office of the P.R.C., First Office Action for Application No. 201280001919.1, Aug. 25, 2015, 10 pages, China.

State Intellectual Property Office of the P.R.C., Search Report for Application No. 201280001919, Aug. 25, 2015, 1 page, China.

The International Bureau of WIPO, International Preliminary Report on Patentability for International Application No. PCT/BR2012/000106, Oct. 15, 2013, 6 pages, Switzerland.

* cited by examiner

TRANSFORMER PROVIDED WITH A TAPS PANEL, AN ELECTRIC-INSULATION METHOD FOR A TAPS PANEL OF A DRY DISTRIBUTION TRANSFORMER, AND A TAPS PANEL FOR A DRY DISTRIBUTION TRANSFORMER

This application claims priority of Brazilian Patent Application PI1101495-4, filed on Apr. 15, 2011, the contents being hereby incorporated by reference.

The present invention relates to a taps panel for a three-phase or single-phase electric transformer, of solid insulation and with shielded and grounded coils, particularly designed for use at underground or submerged distribution installation, or internal or external installation.

DESCRIPTION OF THE PRIOR ART

As known from the prior art, transformers are widely employed for transforming electric energy. Transmission of electric energy is carried out at high voltage as far as close to the consumption places, where, also by means of transformers, it is reduced to values suitable for the pieces of equipment of the consumers. Voltage-level reduction may be made by means of taps, which are essentially connection points along a coil winding, which enables the selection of a given number of turn along the winding. In this way, a transformer produces a proportion of varying turns, thus enabling one to adjust the output voltage to, for example, +5% and −5% of the normal winding voltage.

The selection of the tap for altering the number of winding turns is a usual procedure for adjusting the voltage and is usually indicated on the plate of characteristics and drawings or in the transformer manuals. The taps and the connection bridge are accessible from the outside, the taps being connected, by means of a permanent electric conductor, to the coil winding, the voltage existing on the winding on each tap varying according to the turn to which each tap is connected. The nuts too are accessible from the outside, and each has the voltage of the winding turn to which it is connected, when the transformer is in operation. The voltage with respect to the ground potential of the nut and of the bridge is the same as on the winding turn.

A type of transformer much used and known in the prior art and that makes use of taps is the dry distribution transformer. An example of this type of transformer is shown in document U.S. Pat. No. 5,621,372, which describes a transformer having coils encapsulated in resin, which prevent contact with moisture and, as a result, formation of arcs during condensation of the moisture. Resin is applied by means of vacuum, and the taps panel remains on the outer part of the transformer, without any protection.

Other embodiments of dry distribution transformers used in the prior art are illustrated in FIGS. 1, 2 and 3. Such figures illustrate a 1000-kVA transformer 1, provided with a taps panel 2, which is provided with nuts 3, which are associated to the high-voltage coils, for example, 13.8 kV, encapsulated in resin and connection bridges 4, which are associated to the nuts 3 by means of screws 5, which are tightened with adequate tools in order to guarantee low contact resistance and good continuity of the electric circuit. FIG. 3 further illustrates a protrusion 7 on the outer wall of the transformer 1 housing, which contains the taps panel 2. Usually each nut 3 of the taps panel 2 corresponds to one winding tap. The nuts 3 are usually identified, and the connection bridges 4 are placed as indicated on the plate of characteristics or in documents for the transformer 1, supplied by the manufacturer.

The electric distances between the nuts 3, as well as the distances between the connection bridge 4 and the other nuts 3, should meet the voltage between them. For instance, for a 13,800 volts winding the commutation range of +/−5%, the voltage between the end nuts 3 is 10% of 13,800 volts, that is, 1,380 volts. The voltage of the taps on the panel 2 and of the connection bridge 4 with respect to the ground is the same as the voltage of the taps on the winding with respect to the ground.

The insulation between the nuts 3 and the counter ground is made by the resin present in the internal part and by the distance of air at the outer part.

The disadvantage of these embodiments is the fact that the taps panel is unprotected, since dry distribution transformers are used in internal and protected environments. However, the taps remain unprotected, without insulation in immersion condition, that is, the taps panel does not have a configuration suitable for used in such environments.

An attempt to solve this problem is presented in FIGS. 4 and 5, which illustrate a taps panel of a 13.8 kV transformer, provided with nuts 3, connection bridge 4, a protrusion 7 and screws 5, which have the function of associating the connection bridge 4 to the nuts 3 and fastening the cover (not sown) onto the protrusion 7. FIG. 5 further illustrates an insulation 6 between the nuts 3, which as the function of increasing the surface distance between the nuts 3 and the air.

The disadvantage of these embodiments is the fact that the transformer uses the cover to protect the taps panel from moisture and water. However, this cover only prevents accumulation of dust and has a low degree of electric insulation, so that the air present inside the protrusion may cause an electric discharge because it is ionized, thus damaging the transformer.

A solution to the cited problems is mentioned in document U.S. Pat. No. 3,175,148, which describes a three-phase transformer, wherein the taps are separated ion compartments with doors. Such compartments are sealed and filled with dielectric fluid, which surrounds the taps. This document also describes a strap that is accessible from the outside and allows grounded connection to all the coils associated to the regulating circuit, making the panel electrostatically shielded.

The disadvantage of this embodiment is that fact that the transformer uses a liquid dielectric material, as known from the prior art, liquid dielectric materials are very complex to handle, besides the possibility of being contaminated in case of maintenance, if the operator comes in contact with the material.

Another disadvantage of the liquid dielectric material is the fact that the latter may cause damages to the environment, if it is not discarded correctly.

A further problem of this embodiment is the fact that the operator has to make a ground connection to the grounded step of the transformer.

Moreover, dry transformers require installation at protected places, and the level of moisture which they can bear is defined in the rules, for instance, IEC 60076-11. The installation of dry transformers should meet the minimal electric distances, according to the class of voltage between the parts of the transformers and ground. The distances of the coils, of the connections bridges and of the taps panel with respect to the ground should meet the insulation class. The exception to this rule is the transformer described in patent PI 0903695-4, for which the present invention is particularly applicable. According to the teachings of patent PI0903695-4 (the description of which is incorporated herein by reference), it is possible to operate with a transformer at underground or underwater installations and, in these conditions; the taps panel of the present invention is advantageous over the previous art.

OBJECTIVES OF THE INVENTION

An objective of the present invention is to provide a transformer having a hermetically sealed compartment, which comprises a taps panel insulated by a removable solid resin, electrostatically shielded and that enables the change of taps on shielded coils, thus enabling their use on submersible dry transformers.

It is also an objective of the present invention to provide a transformer with a taps panel that enables taps change, insulation of the taps with solid final insulation at the installation place, to shield electrostatically the taps area, to seal the taps area against the entry of moisture or water, as well as to enable the use thereof on submersible dry transformers.

It is also an objective of the present invention to provide a transformer with a taps panel that enables one to insulate the taps from each other and from the ground by means of an insulating resin applied under vacuum, such insulation with resin under the taps panel enabling the reduction of costs by reducing the amount of material and raising the reliability of the equipment by eliminating air bubbles that may cause partial discharges and reduce the insulating capability and cause failure of the transformer.

More specifically, the objectives of the present invention are:

- To provide covering for the purpose of preventing the entry of water and moisture;
- To provide sealing with a view to prevent the entry of water and moisture;
- To provide a compartment filled with a removable solid dielectric material; and
- To provide an electrostatically shielded taps panel.

BRIEF DESCRIPTION OF THE INVENTION

The objectives of the present invention are achieved by means of a dry distribution transformer comprising a housing, a coil, a compartment and a taps panel associated to the coil. The taps panel has an electrostatic shield and is positioned inside the compartment, which is filled with a solid dielectric material and protected by a cover.

Further, the objectives are achieved by means of a electric-insulation method for a taps panel of a dry distribution transformer, the transformer having a compartment, the compartment comprising a taps panel inside it, and being provided with a cover, the cover having filling channels. The electric-insulation method consists in:

- associating a filling duct to the lower filling channel of the cover, by means of connectors;
- associating an air-outlet duct to the upper filing channel of the cover, by means of connectors;
- filling the cavity with insulating resin through the filling duct;
- applying vacuum through the air-outlet duct;
- dissociating the ducts;
- sealing the filling channels with covers;
- wait until the cure time of the resin is over.

The objectives are also achieved by means of a taps panel for a dry distribution transformer, the transformer comprising at least one high-voltage winding tap and one sealed compartment, the sealed compartment being associated to the transformer housing and being provided with a cavity within which the taps panel is housed, the transformer further comprising sealing configured to prevent entry of water in the compartment and a grounded electrostatic shield connected electrically to a cover, which is also grounded, the sealed compartment being filled with removable solid dielectric material.

BRIEF DESCRIPTION OF THE DRAWINGS

The present invention will now be described in greater detail with reference to the figures.

DETAILED DESCRIPTION OF THE FIGURES AND OF THE INVENTION

Figure 1:
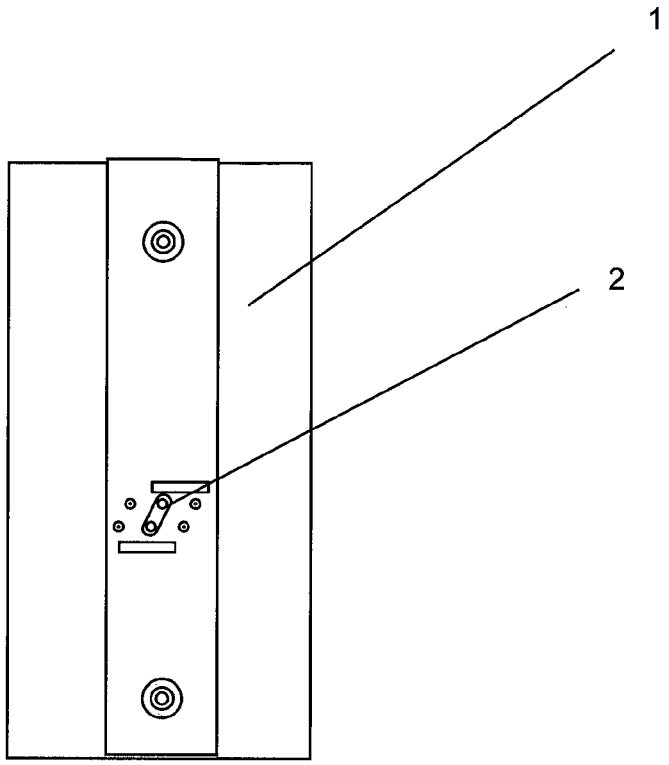
FIG. 1 represents a partial front view of a dry distribution transformer of the prior art, provided with a taps panel.
Figure 2:
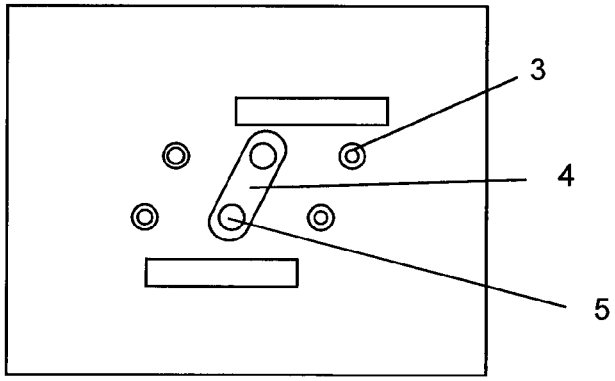
FIG. 2 represents a frontal view of a taps panel of the prior art.
Figure 3:
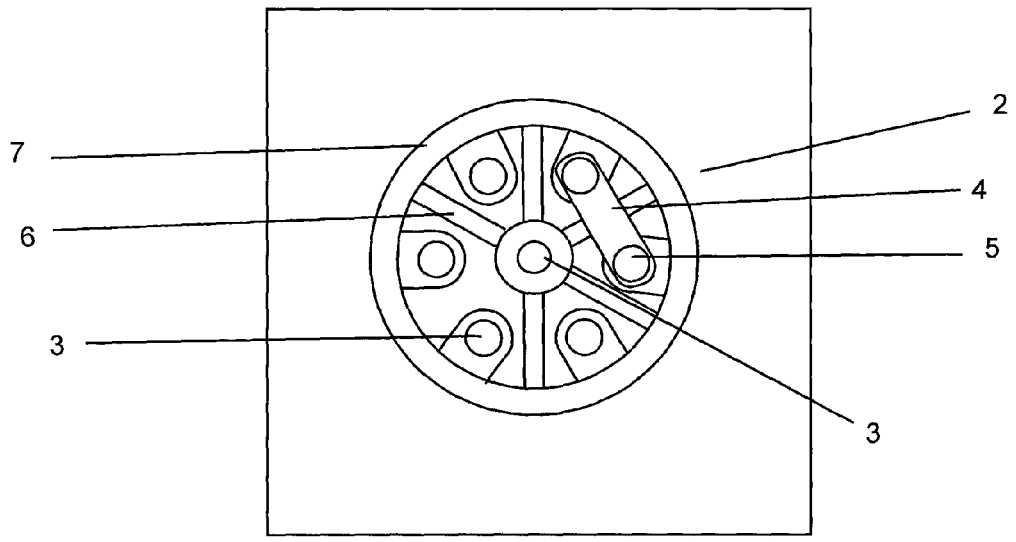
FIG. 3 represents a front view of a taps panel of the prior art.
Figure 5:
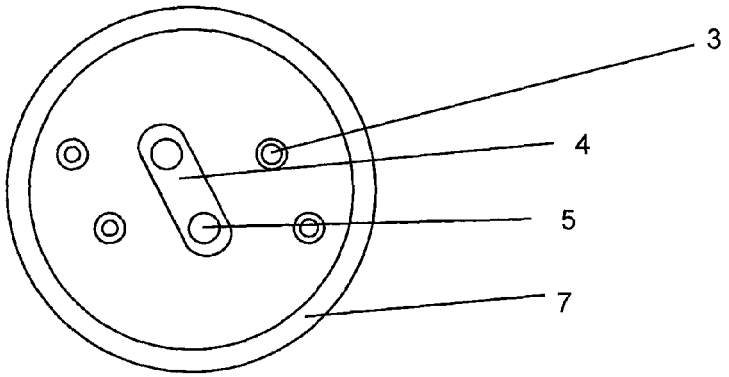
FIG. 5 represents a front view of a taps panel of the prior art.
Figure 4:
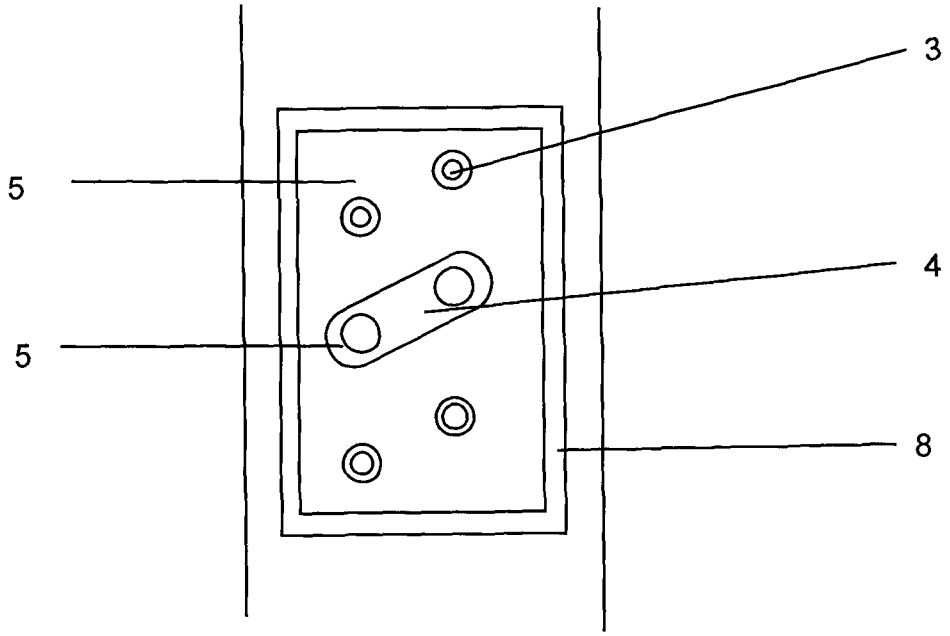
FIG. 4 represents a front view of a taps panel of the prior art.

As one can see in FIGS. 6 to 9, the transformer 1 has a housing 1', manufacture preferably from resin and consisting of a coil 200 encapsulated in resin and shielded electrostatically 107. Close to the outer wall of the transformer, a taps panel 110 is positioned inside a sealed compartment 100.

Said sealed compartment 100 is embodied as a protrusion that begins at the housing 1' of the transformer 1 and forms an outer wall 105 and an inner wall 106.

The inner wall 106 forms a cavity 101 inside the sealed compartment 100, in which a fixation plate 102 and a cover 120 are inserted, the latter being recessed from the end portion 116 of the outer wall 105.

This recess has the objective of preventing accumulation of dirt and the entry of water in the cavity 101, this embodiment being particularly advantageous, since dirt accumulates on the outer wall 105, resulting in a more secure operation during the change of the taps, and this prevents the entry of dirt and the appearance of voltaic arcs, which may damage the transformer 1.

Figure 9:
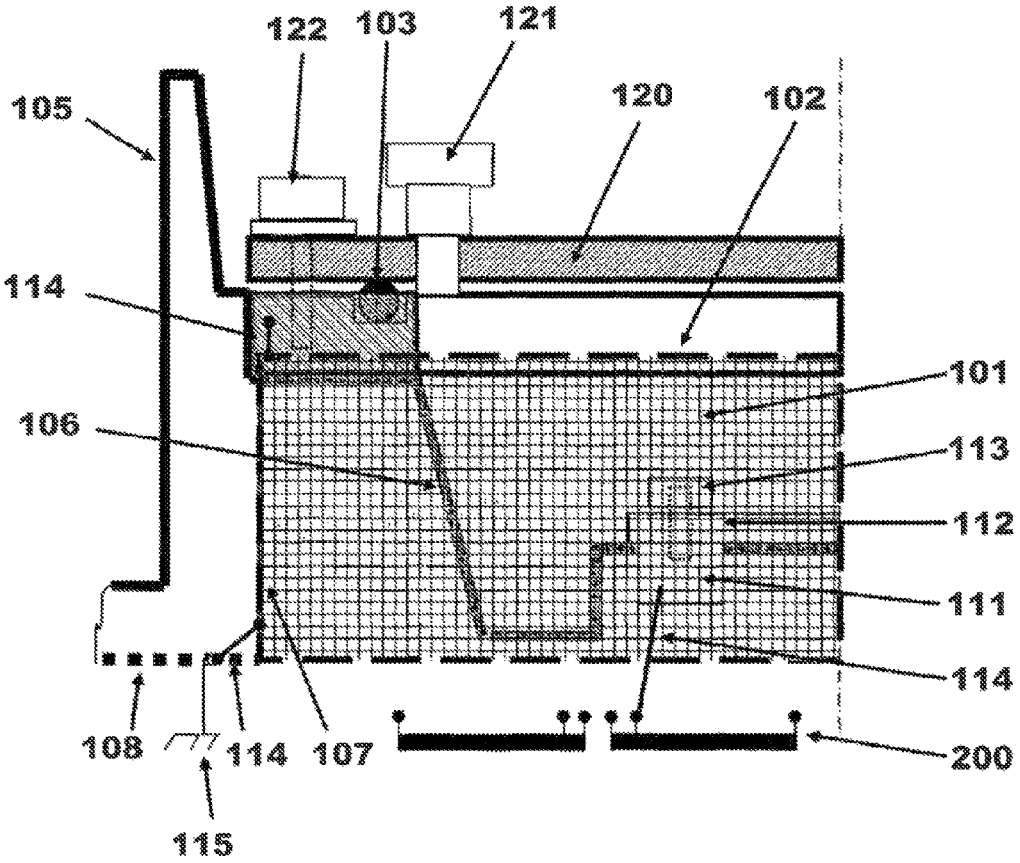
FIG. 9 represents a sectional view of the taps panel.

A preferred embodiment of the sealed compartment 100 is shown in FIG. 9, where it is manufactured as a protrusion on the outer part of the housing 1'. However, such a protrusion may be turned to the inner part of the housing 1', being positioned farther into the innermost portion of the transformer 1. In this way, the dimensions of the inner wall 106 and the depth of the taps panel 110 should be compatible. The walls 105, 106 of the transformer 1 should have a thickness sufficient to receive the recess, thus forming the cavity 101, into which the taps panel 110 will be inserted.

The sealed compartment 100 may have any geometry and is manufactured from resin, preferably epoxy resin. However, other types of resin may be used in manufacturing it, for example, polyurethane, polyester, silicone.

Figure 6:
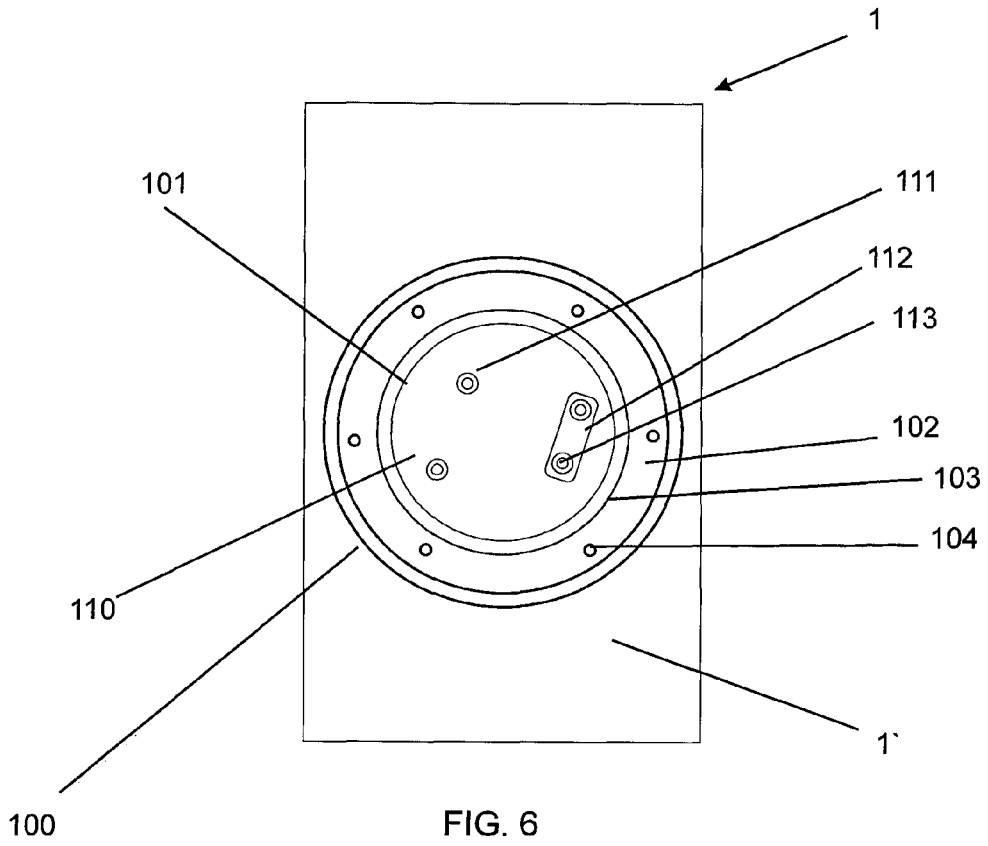
FIG. 6 represents a front view of a taps panel of the present invention.

The cavity 101 of the sealed compartment 100 has receives the taps panel 110. As can be seen in FIGS. 6 and 9, the taps panel 110 is provided with at least one fixation element for fixing the turn 111, a connection bridge 112 and a fixation element for fixing the connection bridge 113. The fixation element of the turn 111 is encapsulated together with the coil body 200 and is electrically linked 114 to the turns, the connection bridge 112—which is used to establish electric connection between two fixation elements of the turn 111—being fastened to the fixation element of the turn 111 by means of the fixation element of the connection bridge 113.

The fixation element of the turn 111 is preferably a nut, but other types of joining elements may be used. On the other hand, the fixation element of the connection bridge 113 is preferably a screw, but other types of fixation elements may be used, for example, rivets, pins, bolts.

As can be seen in detail in FIG. 9, the taps panel 110 has an electrostatic shield 107, which is electrically connected 114 to the electrostatic shield 107 of the coil 200, which in turn is connected to ground 115. Such electrostatic shield 107 extends involving the outer wall of the cavity from a lower portion of the cavity 101 until an outermost portion of the cavity 101, more exactly in the region of the fixation plate 102, being positioned between the inner wall 106 and the outer wall 105 of the compartment 100. The inner wall 106 together with the removable resin insulate electrically the voltage of the taps with respect to the ground 115.

The fixation plate 102 is located inside the sealed compartment 100, more specifically in the cavity 101, as shown in FIGS. 6 and 9. It is encapsulated together with the sealed compartment 100, forming adherence between its outer wall and the inner wall 106 of the sealed compartment 100.

The fixation plate 102 comprises a groove 130 and association elements of the cover 104 at its front part, and is electrically connected 114 to the electrostatic shield 107 of the cavity 101 and to the electrostatic shield 107 of the coil 200. A preferred embodiment is made from metallic material, but other types of conductive materials may be used to manufacture it, for example aluminum, copper, semi-conductive paint, semi-conductive resin.

The groove 130 present on the fixation plate 102 is filled by sealing 103, which has the objective of sealing the cavity 101, preventing the entry of water and moisture into the sealed compartment 100. The sealing is associated operatively to the fixation plate 120 by means of a cover 120, which is associated to the fixation plate 102. The cover 120 presses the sealing 103 against the groove 103 of the fixation plate 102, thus sealing the entrance of the cavity.

The sealing is preferably an O-ring, as shown ion FIGS. 6 and 9, but other types of sealing materials may be employed, as for example, silicone, polyurethane.

Figure 7:
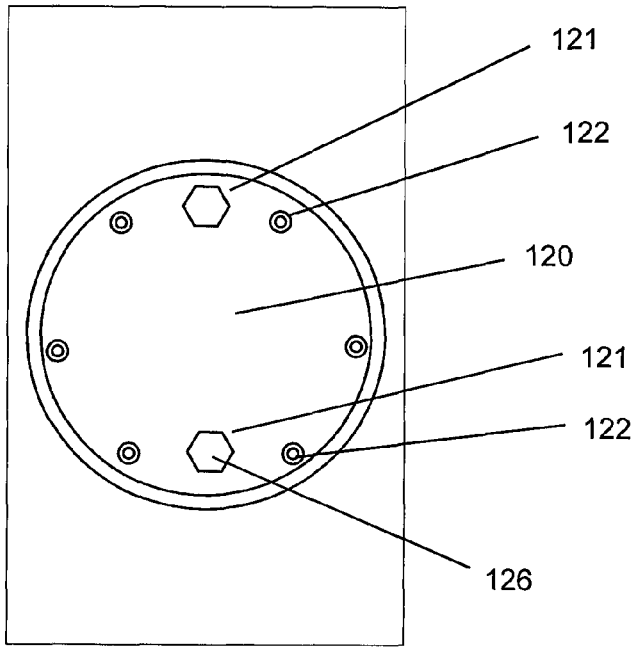
FIG. 7 represents a front view of the taps panel provided with a cover.
Figure 8:
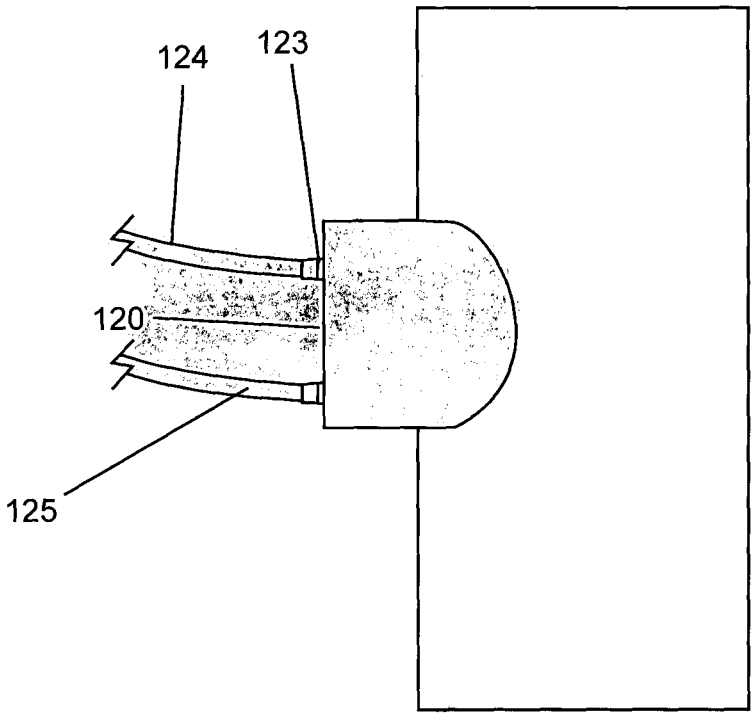
FIG. 8 represents a side view of the taps panel being filled with dielectric material.

As can be seen in FIGS. 7, 8, and 9, the cover 120 has two filling channels 121 and is electrostatically shielded 107 by contact of its surface with the surface of the fixation plate 102, which is connected to the ground 115.

The cover 120 is grounded 115 due to the electric contact with the fixation plate 102, also grounded 115, by means of fixation elements of the cover 122, which has the objective of establishing electric connection between the cover 120 and the fixation plate 102 grounded 115.

Such fixation elements of the cover 122 are preferably screws, but other types of fixation elements may be used, as for example rivets, pins, bolts. On the other hand, the cover 120 is composed preferably of a metallic material, but other types of material may be used for manufacturing it, as for example materials composed of resin with conductive material.

The filling channels 121 are used for filling the cavity 101 with removable insulating material, and are positioned on the outer surface of the cover 120. They have connectors 123, to which covers 126 are associated, which protect the filling channels 121 and prevent the entry of water into the cavity 101.

The removable insulating has the objective of isolating the taps panel 110, enabling the latter to be employed on high-voltage transformers, as for example, of 72.5 kV or 138 kV. The removable insulating material may be composed, for instance, by resin 3M of type "High Gel Re-Enterable Encapsulant 8882". By making use of this removable insulating material, the cure time will be of about 60 minutes. After this time, the material has a gelatin consistency, thus becoming an easily removable material.

To replace the resin mentioned before, other types of materials may be used, as for example a pasty insulating material, and others that fulfill the function which the present invention requires.

In order to fill the cavity 101, the cover 120 is provided with first connector 123 and second connecter 123, connected to an air-outlet duct 124 and to a filling duct 125. The air-outlet duct is used for applying vacuum, providing total withdrawal of the air present in the cavity 101 and the filing duct 125 is used to convey the resin that will fill the cavity 101.

The connection between the air-outlet duct 125 with the first connector 123 and the connection between the filling duct 124 with second connector 123 is made preferably by threading. However, other types of connection may be used, as for instance, engagement connection.

A preferred method for filling the cavity 101 using such ducts consists in connecting the filling duct 125 to the lower filling channel 121 and connecting the air-outlet duct 124 to the upper filling channel 121. Through the filling duct 125, one applies the insulating resin into the cavity 101 and through the air-outlet duct 124 one applies vacuum, withdrawing air from the cavity 101, thus eliminating the appearance of air bubbles, which may cause the appearance of electric discharges, which damage the transformer.

Another method to be used consists in connecting the filling duct 125 to the lower filling channel 121 and connecting the air-outlet duct to the upper filling channel 121. Through the filling duct 125, one applies the insulating resin into the cavity 101 and through the air-outlet duct 124 only passage of air takes place, the resin being applied by gravity.

Thus, as already described, the use of the taps panel 110, according to the present invention enables the employ of the transformer in underground distribution networks for operation in submerged environments, for instance.

One advantage of the dry distribution transformer of the present invention relates to the fact that the taps panel is electrostatically shielded. The electric field existing between the taps and the ground is confined in the insulation existing between the taps and the grounded electrostatic shield. The taps are at the same potential as the winding turns to which they are connected, but they are insulated and with the outer electrostatic shield grounded, that is, they are ensured against electric shocks and against discharges to the installation, thus raising the safety of the operator and the useful life of the equipment.

Moreover, the constitution of the dry distribution transformer as proposed has, as an advantage over the prior art transformers, the fact of being provided with a compartment insulated by a solid resin, electrostatically shielded and hermetically sealed, enabling the employ of the taps panel on high-voltage transformers, as for instance, o transformers of 13.8 kV or 24.2 kV and with power ranging from 500 kVA to 2000 kVA.

Another advantage of the present invention refers to the fact that the taps panel is provided with a grounded metallic cover, which has two connectors, to which ducts for filling with removable insulating resin are associated. The two connectors have removable covers, which enable one to seal the taps panel against the entry of water.

A further advantage of the dry distribution transformer of the present invention refers to the fact that the compartment is free from insulating oils, which might contaminate the environment, if they were not discarded correctly, or might be contaminated during preventive maintenance of the transformer, causing them to lose their initial insulating characteristics. Another advantage of the present invention refers to the fact that the cover is screwed to a fixation plate and between the cover and the fixation plate there is a sealing, which is pressed by the cover against the fixation plate, whereby the sealing against the entry of moisture through the joining surface of the elements is affected.

The use of the cover with connectors on its surface enables one to fill the cavity of the taps panel with removable insulating resin. In the resin filling process one may apply vacuum, so that the resin will be free from air bubbles and the compartment will be free from air bubbles, being totally filled with the insulating resin, whereby their dielectric characteristics are enhanced and a failure of the equipment is prevented. Thus, the taps panel may be used on transformers with higher voltages, as for example, 72,500 volts or 138,000 volts. Additionally, since the taps panel has better dielectric characteristics, it may be manufactured with more reduced dimensions, thus bringing about saving of material, further providing the transformer with isolating resin for filling the sealed compartment, which is removable.

Another advantage of the dry distribution transformer of the present invention refers to the fact that the electrostatic shield of the taps panel and the electrostatic shield of the coil are connected to ground, and so there is no risk of electric discharges to persons and objects that come into contact with the transformer or that are close to it. Besides, the air surrounding the coil is not ionized or subjected to an electric field.

Moreover, the use of the electrostatic shield on the taps panel and on the coils, together with the sealing, enables the use of the taps panel on dry distribution transformers for submerged use, foreseen for employ on underground distribution networks, typically of 13,800 volts or 24,200 volts or 23,500 volts and typical powers of 500 kVA to 2,000 kVA.

A preferred embodiment having been described, one should understand that the scope of the present invention embraces other possible variations, being limited only by the contents of the accompanying claims, which include the possible equivalents.

The invention claimed is:

1. A dry distribution transformer comprising at least:

a housing, the housing comprising at least one coil positioned inside the housing;

a sealed compartment, the sealed compartment being a protrusion that begins at the housing, the sealed compartment being provided with a cavity;

a taps panel positioned inside the cavity of the sealed compartment, the taps panel comprising at least two fixation elements of the turn, a connection bridge, and a fixation element for fixing the connection bridge; and a fixation plate positioned inside the cavity of the sealed compartment;

wherein:

the taps panel is electrically associated with the coil via an encapsulation of the at least two fixation elements of the turn with the coil and via a first electric connection between the at least one fixation element of the turn and turns of the coil, the connection bridge establishes a second electric connection between the at least two fixation elements of the turn, the connection bridge being fastened to the fixation elements of the turn via the fixation element for fixing the connection bridge, the cavity is being filled with a removable solid dielectric material, and a sealing is operatively associated to the fixation plate so as to seal the cavity and the removable solid dielectric material therein.

2. The dry distribution transformer according to claim 1, wherein the cavity is protected by a cover.

3. The dry distribution transformer according to claim 1, wherein the fixation plate is associated to the internal portion of the sealed compartment, the fixation plate comprising a groove for inserting the sealing.

4. The dry distribution transformer according to any one of claims 1, 2, or 3, wherein the fixation plate is grounded.

5. The dry distribution transformer according to any one of claims 1, 2, or 3 the fixation plate is composed of a metallic material.

6. The dry distribution transformer according to any one of claims 1, 2, or 3 to 5, wherein the cover is fastened to the fixation plate by means of fixation elements of the cover.

7. The dry distribution transformer according to claim 2, wherein the cover has, on its outer part, a pair of filling channels.

8. The dry distribution transformer according to claim 7, wherein the filling channels are operatively associated to a filling duct and to an air-outlet duct by means of connectors.

9. The dry distribution transformer according to any one of claims 1, 2, or 3 to 8, wherein the taps panel has an electrostatic shield.

10. The dry distribution transformer according to claim 1, wherein the removable solid dielectric material has a gelatin consistency.

11. The dry distribution transformer according to claim 1, wherein the sealing is an O-ring.

12. The dry distribution transformer according to claim 1, wherein the sealing is composed of a polymeric material.

13. The dry distribution transformer according to claim 9, wherein the electrostatic shield of the coil is electrically associated to the electrostatic shield of the taps panel.

* * * * *